US010175708B2

(12) United States Patent
Ogura

(10) Patent No.: US 10,175,708 B2
(45) Date of Patent: Jan. 8, 2019

(54) POWER SUPPLY DEVICE

(71) Applicant: KABUSHIKI KAISHA TOSHIBA, Tokyo (JP)

(72) Inventor: Akio Ogura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/685,865

(22) Filed: Aug. 24, 2017

(65) Prior Publication Data

US 2018/0224876 A1 Aug. 9, 2018

(30) Foreign Application Priority Data

Feb. 8, 2017 (JP) ..... 2017-021597

(51) Int. Cl.
*G05F 1/575* (2006.01)
*G05F 1/59* (2006.01)

(52) U.S. Cl.
CPC ..... *G05F 1/59* (2013.01); *G05F 1/575* (2013.01)

(58) Field of Classification Search
CPC ... G05F 1/46; G05F 1/461; G05F 1/56; G05F 1/565; G05F 1/575; G05F 1/59
See application file for complete search history.

(56) References Cited

U.S. PATENT DOCUMENTS 6,700,360 B2 * 3/2004 Biagi ..... G05F 1/575 323/275
8,054,052 B2 11/2011 Noda
8,665,020 B2 3/2014 Sakurai et al.
2009/0066306 A1 * 3/2009 Noda ..... G05F 1/575 323/282
2012/0038332 A1 * 2/2012 Lin ..... G05F 1/575 323/277
2014/0184182 A1 * 7/2014 Yajima ..... G05F 1/575 323/273
2016/0099644 A1 * 4/2016 Tsuzaki ..... G05F 1/573 323/271

(Continued)

FOREIGN PATENT DOCUMENTS

JP 2001075663 A 3/2001
JP 4937865 B2 5/2012

(Continued)

*Primary Examiner* — Matthew Nguyen
(74) *Attorney, Agent, or Firm* — Patterson & Sheridan, LLP

(57) ABSTRACT

A power source device includes an output transistor connected between an input node at which an input voltage can be received and an output node at which an output voltage corresponding to the input voltage can be output according to a control voltage applied to a gate of the output transistor, a first amplifier that includes a first transistor element and a second transistor element having gates to which a first voltage is applied, receives a feedback voltage corresponding to the output voltage, and outputs a second voltage corresponding to a voltage difference between the feedback voltage and a reference voltage, a monitor transistor having a gate to which the first voltage is applied, a first current source that supplies a first current to the first amplifier, and a second current source that supplies a second current to the first amplifier according to a current flowing in the monitor transistor.

20 Claims, 11 Drawing Sheets

(56) References Cited

U.S. PATENT DOCUMENTS

2017/0205840 A1 7/2017 Ogura

FOREIGN PATENT DOCUMENTS

| | | | |
|---|---|---|---|
| JP | 2012155395 | A | 8/2012 |
| JP | 5527056 | B2 | 6/2014 |
| JP | 5828206 62 | | 12/2015 |
| JP | 2017126259 | A | 7/2017 |

* cited by examiner

POWER SUPPLY DEVICE

This application is based upon and claims the benefit of priority from Japanese Patent Application No. 2017-021597, filed Feb. 8, 2017, the entire contents of which are incorporated herein by reference.

FIELD

Embodiments described herein relate generally to a power source device.

BACKGROUND

Generally, an electric apparatus includes a power source device for supplying an appropriate voltage to such things as an integrated circuit, a sensor, or a driver circuit. A switching regulator or a linear regulator can be included in examples of such a power source device. In recent years, power source devices have been increasingly applied to battery-powered mobile devices, and thus, it is increasingly desired that these power source devices achieve both low current consumption and high speed response.

For example, a method to keep an output voltage of the power source device constant is known. In this method, an operational current providing to an amplifier in the power source device is increased when the output voltage decreases. However, when a difference between a threshold value for determining an abnormal voltage and a normal voltage is set to be small, there may be a case where the additional current continues to erroneously flow into the amplifier, which increases current consumption. On the other hand, when the voltage difference is set to be large, the current in the amplifier does not increase if the output voltage does not significantly deviate from the normal voltage, which hinders high speed response. Furthermore, there is a problem of how to increase the current in the amplifier in response to the decrease of the output voltage. As described above, the achievement of low current consumption and the achievement of high speed response are in conflict. Therefore, it is desired to obtain a method for achieving both the low current consumption and the high speed response.

DETAILED DESCRIPTION

In general, according to one embodiment, a power source device includes an output transistor connected between an input node at which an input voltage can be received and an output node at which an output voltage corresponding to the input voltage can be output according to a control voltage applied to a gate of the output transistor, a first amplifier that includes a first transistor element and a second transistor element having gates to which a first voltage is applied, receives a feedback voltage corresponding to the output voltage, and outputs a second voltage corresponding to a voltage difference between the feedback voltage and a reference voltage, a monitor transistor having a gate to which the first voltage is applied, a first current source that supplies a first current to the first amplifier, and a second current source that supplies a second current to the first amplifier according to a current flowing in the monitor transistor.

Hereinafter, example embodiments of the present disclosure will be described with reference to the drawings.

First Embodiment

Figure 1:
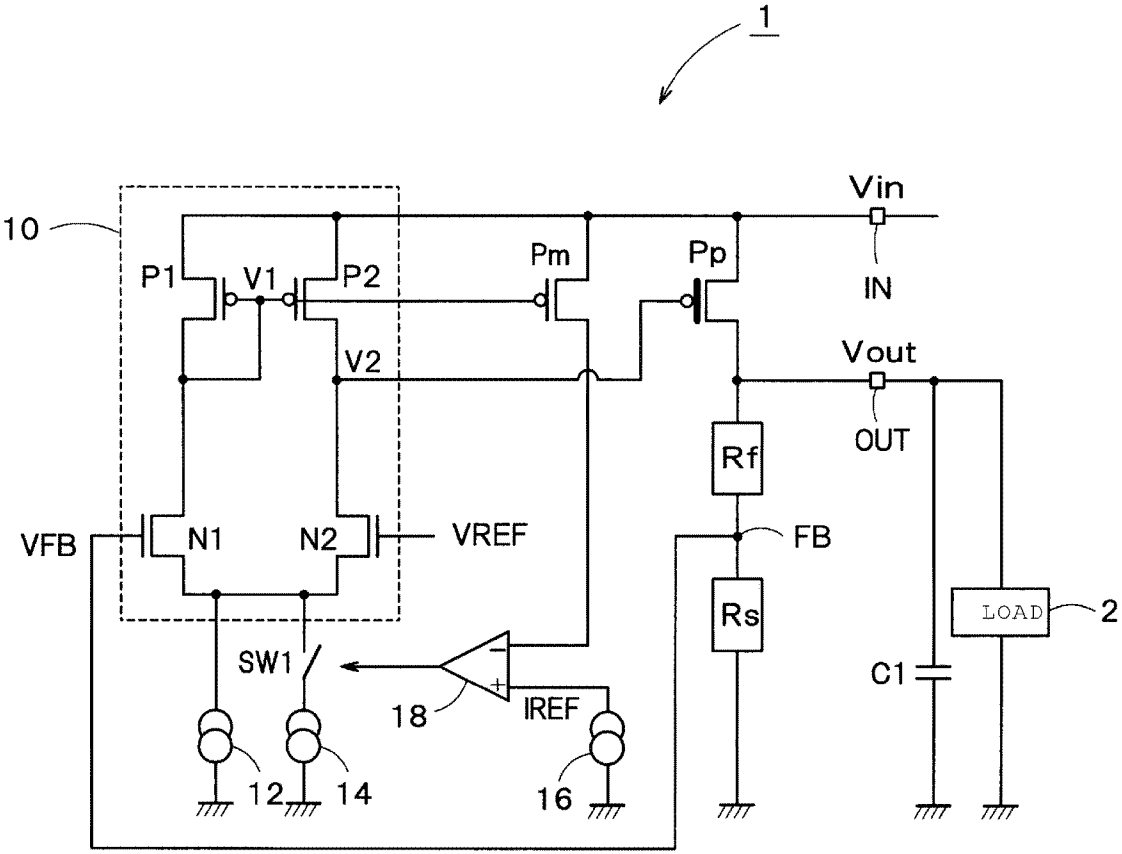
FIG. 1 is a circuit diagram illustrating a configuration of a power source device according to a first embodiment.

FIG. 1 is a circuit diagram illustrating a configuration of a power source device 1 in a first embodiment. FIG. 1 illustrates a linear regulator as an example of the power source device 1.

The power source device 1 in FIG. 1 includes a first amplifier 10, a first current source 12, a second current source 14, a reference current source 16, a current comparator 18, a first transistor Pp, a second transistor Pm, a first switch SW1, and resistors Rf and Rs. Here, the first transistor Pp and the second transistor Pm are pMOS transistors.

FIG. 1 further illustrates an input terminal IN and an output terminal OUT of the power source device 1, and a load 2 and a capacitor C1 connected to the output terminal OUT respectively. In this power source device 1, the circuit configuration between the input terminal IN and the output terminal OUT can be realized as one semiconductor chip.

The first transistor Pp is an output transistor that outputs an output voltage Vout according to an input voltage Vin. A source of the first transistor Pp is connected to the input terminal IN and a drain of the first transistor Pp is connected to the output terminal OUT. The input voltage Vin is input to the first transistor Pp from the input terminal IN. The output voltage Vout is output to the output terminal OUT from the first transistor Pp. The first transistor Pp regulates a current corresponding to the load 2 connected to the output terminal OUT and outputs the result.

The resistors Rf and Rs are connected to each other between the drain of the first transistor Pp and a ground node. The resistors Rf and Rs divide the output voltage Vout and generate a feedback voltage VFB. The feedback voltage VFB is applied to the first amplifier 10 from a node FB between the resistors Rf and Rs.

The first amplifier 10 is a differential amplifier circuit that amplifies the voltage difference between the two input voltages, and includes transistors N1, N2, P1, and P2. The transistors N1 and N2 are nMOS transistors and are provided as differential input elements. The transistors P1 and P2 are pMOS transistors and are provided as active load elements. The transistor P1 is an example of a first element and the transistor P2 is an example of a second element.

The sources of both the transistors P1 and P2 are connected to the input terminal IN. Drains of the transistors P1 and P2 are connected to drains of the transistors N1 and N2 respectively. Gates of the transistors P1 and P2 are connected to each other and are also connected to the drain of the transistor P1. FIG. 1 depicts a first voltage V1 as a gate voltage of the transistors P1 and P2 and a second voltage V2 as generated at the drain of the transistor P2.

Sources of the transistors N1 and N2 are connected to the first current source 12 and can also be connected to the second current source 14 via the first switch SW1 being closed. The feedback voltage VFB, corresponding to the output voltage Vout, is applied to a gate of the transistor N1. A reference voltage VREF, which is a constant voltage, is applied to a gate of the transistor N2.

The input nodes of the first amplifier 10 are the gates of the transistors N1 and N2 and the output node of the first amplifier 10 is between the drain of the transistor N2 and the drain of the transistor P2. Accordingly, the feedback voltage VFB and the reference voltage VREF are input to the input nodes of the first amplifier 10, and a voltage corresponding to a difference between the feedback voltage VFB and the reference voltage VREF is amplified to the second voltage V2, and then, the second voltage V2 is output from the output node of the first amplifier 10. The second voltage V2 is applied to the gate of the first transistor Pp and the first transistor Pp is controlled by the second voltage V2. The first amplifier 10 adjusts the second voltage V2 such that the feedback voltage VFB and the reference voltage VREF will become equal to each other.

The first current source 12 is a constant current source that supplies a current flowing into the first amplifier 10. The second current source 14 is a constant current source that supplies a current flowing into the first amplifier 10 when the first switch SW1 is in an ON state (first SW1 is closed).

The second transistor Pm is a monitor transistor that monitors the output current of the transistors P1 and P2 and outputs a current corresponding to the output current of the transistors P1 and P2. A source of the second transistor Pm is connected to the input terminal IN. A drain of the second transistor Pm is connected to an inverting input terminal (the (−) input terminal) of the current comparator 18. A gate of the second transistor Pm is connected to the gates of the transistors P1 and P2 and the first voltage V1 is applied thereto. The second transistor Pm forms a current mirror circuit with the transistors P1 and P2, and outputs a current proportional to the output current of the transistor P1 or the output current of the transistor P2.

The reference current source 16 is a constant current source that supplies a reference current IREF at constant current level to be used as the threshold value at a non-inverting input terminal (the (+) input terminal) of the current comparator 18. The current comparator 18 compares the output current of the second transistor Pm and the reference current IREF, and outputs an output signal indicating the result of the comparison for controlling the first switch SW1.

The first switch SW1 is operated based on the output signal from the comparator 18, and specifically, switches whether or not current is supplied to the first amplifier 10 from the second current source 14 based on the comparison of the output current of the second transistor Pm to the reference current IREF. For example, in a case where output current of the second transistor Pm is larger than the reference current IREF, the first switch SW1 is placed in an OFF state, and the current is not supplied to the first amplifier 10 from the second current source 14. On the other hand, in a case where the output current of the second transistor Pm is smaller than the reference current IREF, the first switch SW1 is placed in an ON state, and the current is supplied to the first amplifier 10 from the second current source 14.

In the power source device 1 in the first embodiment, a feedback path works such that the output voltage Vout becomes a voltage obtained by multiplying the reference voltage VREF by the resistance value of the resistor Rf and the resistor Rs. Accordingly, the power source device 1 becomes a constant voltage circuit that keeps the output voltage Vout constant even when the current flowing in the load 2 is changed.

The power source device 1 in the first embodiment does not directly compare the output voltage Vout to the threshold value (reference voltage) for determining an abnormal voltage state using a voltage comparator, but rather compares the output current of the second transistor Pm to the threshold value (reference current IREF) using the current comparator 18.

In a case of a voltage comparison type circuit, since the change of the output voltage Vout can be small, there is a problem in that it is difficult to set the reference voltage. For example, when the difference between the output voltage Vout and the reference voltage is small, in some cases, the current may continue to erroneously flow into the first amplifier 10 from the second current source 14, which results in increased current consumption. On the other hand, when the difference is set large, the current does not flow into the first amplifier 10 from the second current source 14 if the output voltage Vout does not significantly deviate from the reference voltage, which results in a hindrance to the high speed response.

This problem can be solved by adopting a current comparison type circuit. The reason is because it is not necessary to keep the output current of the second transistor Pm constant though it is generally necessary to keep the output voltage Vout as constant as possible. Accordingly, in the first embodiment, by adopting the method in which the output current of the second transistor Pm and the reference current IREF are compared with each other, it becomes unnecessary to set the reference current IREF with high accuracy, and thus, it becomes easier to set the reference current IREF. Therefore, according to the present embodiment, it is possible to achieve both low current consumption and the high speed response from the power source device 1.

In the first embodiment, it is not necessary to make the sizes (e.g., gate width or the like) of the transistors P1 and P2 large when the size of the first transistor Pp can be large because it is an output transistor. Accordingly, the transistor P1 and the transistor P2 in the first embodiment can be designed to have sizes smaller than the size of the first transistor Pp, and can thus operate at a higher speed than the first transistor Pp. Therefore, the second transistor Pm can quickly cope with a change of the output voltage Vout by monitoring the output current of the transistors P1 and P2 rather than the output current of the first transistor Pp.

On the other hand, the size of the second transistor Pm may be larger than the sizes of the transistors P1 and P2 or may be smaller than the sizes of the transistors P1 and P2. The second transistor Pm in the first embodiment is designed to have a size approximately ½ to ⅕ of the sizes of the transistors P1 and P2. Since the second transistor Pm in the first embodiment does not monitor the output current of the first transistor Pp but monitors the output current of the transistors P1 and P2, the size of the second transistor Pm can be reduced.

Next, an operation of the power source device 1 in the first embodiment will be described in detail.

In order to reduce a current consumption in the power source device 1, the current from the first current source 12 is a small current. During a normal operation of the power source device 1, the currents flowing in the transistor P1 and the transistor P2 (or in the transistor N1 and the transistor N2) are the same. Specifically, a current of half the value of the small current from the first current source 12 flows in the transistor P1 and the transistor P2 respectively.

However, immediately after the load 2 increases, the output voltage Vout gradually decreases and a gate voltage of N1 also decreases. Since current flowing in the transistor N1 decreases, the current flowing in transistor P1 decreases. The current flowing in the transistor N2 increases and the current flowing in the transistor P2 decreases. Therefore, this difference current discharges the electric charges in the gate parasitic capacitance of the first transistor Pp, and acts to decrease the gate voltage (that is, the second voltage V2) of the first transistor Pp. When this gate voltage is decreased, the first transistor Pp increases the output voltage Vout in order to increase the output current. As described above, in a case where the current flowing in the transistors P1 and P2 is small, the feedback circuit works such that the output current of the first transistor Pp increases.

The second transistor Pm monitors the current flowing in the transistors P1 and P2, and the current comparator 18 compares the output current from the second transistor Pm with the reference current IREF. The output current from the second transistor Pm can be referred to as a "drive current."

In a case where the drive current exceeds the reference current IREF, the load 2 is determined to be small, and thus, the low current consumption mode in which the first switch SW1 is in an OFF state, is maintained. In this case, although the small current is supplied to the first amplifier 10 from the first current source 12, the current is not supplied to the first amplifier 10 from the second current source 14. The current from the second current source can be referred to as an "addition current." Therefore, in the low current consumption mode, the current consumption in the power source device 1 can be kept low.

On the other hand, in a case where the drive current is lower than the reference current IREF, the load 2 is determined to be large, the mode is shifted to a high speed response mode in which the first switch SW1 is in an ON state. In this case, the small current is supplied to the first amplifier 10 from the first current source 12 and the addition current is also supplied to the first amplifier 10 from the second current source 14. Therefore, in the high speed response mode, the first transistor Pp can be controlled at a higher speed as compared to that in the low current consumption mode.

Since the size of the first transistor Pp determines a current rating of the linear regulator, the size is required to be large enough to supply a large current such as several hundreds of milliamperes (mA), in some cases, so as to supply a large current of a few amperes. Accordingly, in a case where the first transistor Pp is a MOS transistor, several tens of picofarads (pF) of parasitic capacitance exists in the gate of the first transistor Pp. Therefore, if the gate voltage of the first transistor Pp is to be generated with only the small current, it may take a time of several tens to several hundreds of microseconds to switch the first transistor Pp. In this case, the output voltage Vout largely changes according to the load current during this delay time.

Therefore, in the first embodiment, the linear regulator that can respond to the change of the load current at a higher speed is realized by focusing on the transistors P1 and P2 in which the conductance state changes at a point earlier than when the output current of the first transistor Pp changes. Since the sizes of the transistors P1 and P2 in the first embodiment are small and there are no elements having a larger size, such as the first transistor Pp, in the vicinity of the transistors P1 and P2, the switching delay of the transistors P1 and P2 due to the parasitic capacitance is small (for example, less than a few microseconds). Accordingly, it is possible to quickly detect the change of the load current by supplying the addition current while monitoring the states of the transistors P1 and P2, and thus, it is possible to more quickly change the gate voltage of the first transistor Pp. That is, the mode is quickly shifted to a high speed response mode from a low current consumption mode, and thus, it is possible to quickly adjust the fluctuations in the output voltage Vout.

For example, in a case where the load 2 rapidly increases, the current flowing in the transistors P1 and P2 becomes almost zero before the addition current is supplied. The reason is because, since the load current does not change instantly even if the load 2 rapidly increases, the output voltage Vout and the feedback voltage VFB decrease and the current does not flow much in the transistor N1, and consequently, the current does not flow much in the transistors P1 and P2. However, since the decrease of the current in the transistors P1 and P2 can be quickly detected by the second transistor Pm, the mode can be quickly shifted to the high speed response mode from the low current consumption mode. In addition, the addition current in the first embodiment does not have a value that is necessarily proportional to the load current but rather has a constant value not varying with the load current. Therefore, it is possible to obtain a sufficient addition current even when the load current is small, and it is possible to avoid an excessively large addition current when the load current is large.

The power source device 1 in the first embodiment has a basic configuration in which a circuit for monitoring the output current of the first transistor Pp is not included. Accordingly, when a fluctuation of the output voltage Vout is received, the mode is returned to the low current consumption mode regardless of an amount of the load current.

Figure 2:
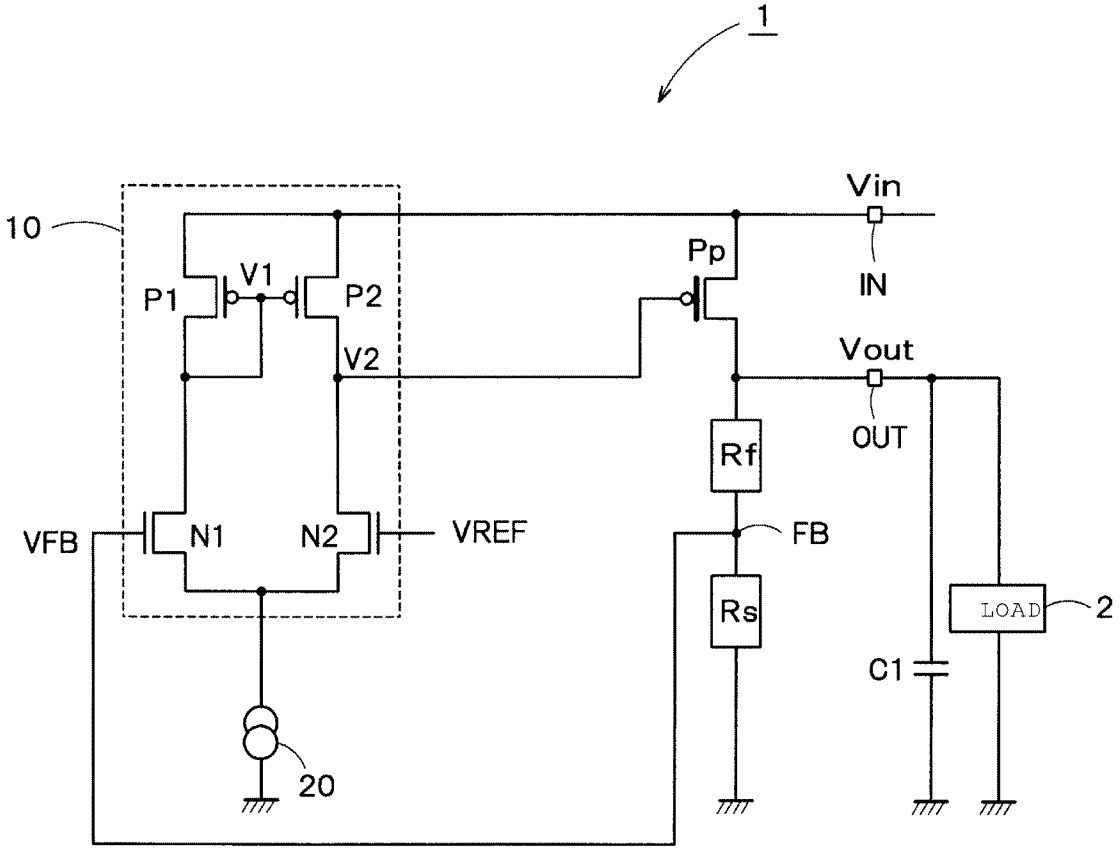
FIG. 2 is a circuit diagram illustrating a configuration of a power source device in a comparison example.

FIG. 2 is a circuit diagram illustrating a configuration of a power source device 1 in a comparison example.

The power source device 1 in FIG. 2 does not include the first current source 12, the second current source 14, the reference current source 16, the current comparator 18, the second transistor Pm, and the first switch SW1, but rather includes only a current source 20.

Hereinafter, an operation of the power source device 1 (FIG. 1) of the first embodiment will be described in comparison to an operation of the power source device 1 (FIG. 2) of the comparison example.

Figure 3A:
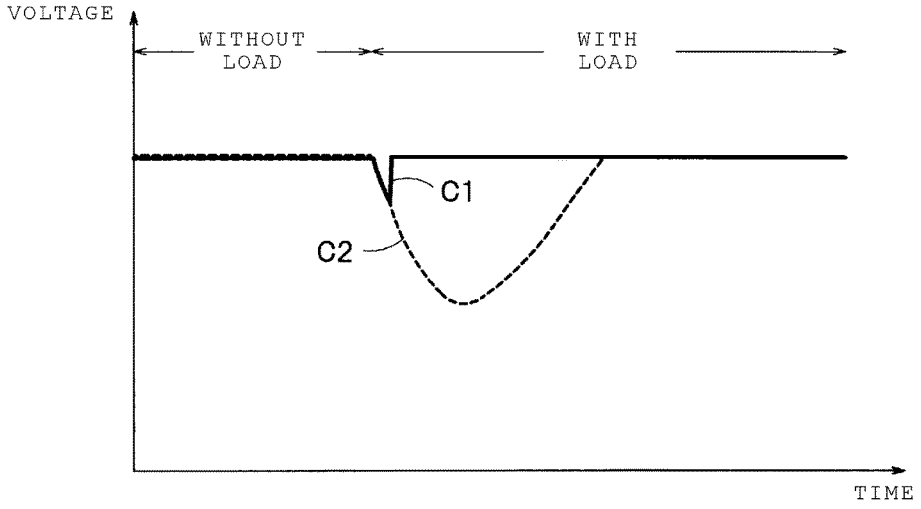
FIG. 3A and FIG. 3B are waveform diagrams for describing operation of the power source devices according to the first embodiment.
Figure 3B:
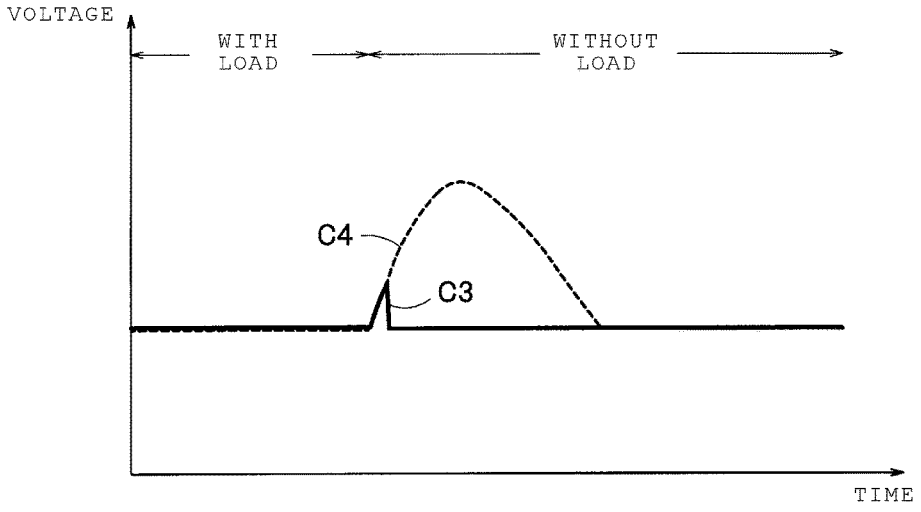

FIG. 3A and FIG. 3B are waveform diagrams for describing operation of the power source devices 1 in the first embodiment.

In FIG. 3A, a curve C1 indicates a temporal change of the output voltage Vout of the power source device 1 of the first embodiment, and a curve C2 indicates a temporal change of the output voltage Vout of the power source device 1 of the comparison example. The curves C1 and C2 indicate the changes of the output voltages Vout from a state in which the load 2 is not present to a state in which the load 2 is present.

In the comparison example, when the load 2 is initially connected, the output voltage Vout temporarily decreases along with the increase of the load current. However, the output voltage Vout eventually returns to the original value due to an action of the power source device 1 (curve C2).

In the first embodiment, this phenomenon is similarly seen (curve C1). However, the maximum amount of change of the output voltage Vout in the first embodiment is approximately ¼ of that in the comparison example. As described above, according to the first embodiment, it is possible to suppress the change of the output voltage Vout by improving the high speed response characteristics of the power source device 1.

In FIG. 3B, a curve C3 indicates a temporal change of the output voltage Vout of the power source device 1 in the first embodiment, and a curve C4 indicates a temporal change of the output voltage Vout of the power source device 1 in the comparison example. The curves C3 and C4 indicate the changes of the output voltages Vout when a state in which the load 2 is present to a state in which the load 2 is not present. In the curves C3 and C4, a phenomenon similar to that seen in the curves C1 and C2 can be seen.

However, in this instance the waveform of the curve C3 is realized by a power source device 1 corresponding to that depicted in FIG. 5 (as further described below), rather than the power source device 1 in FIG. 1. The differences between the curve C1 and the curve C3 will be described below.

Figure 4A:
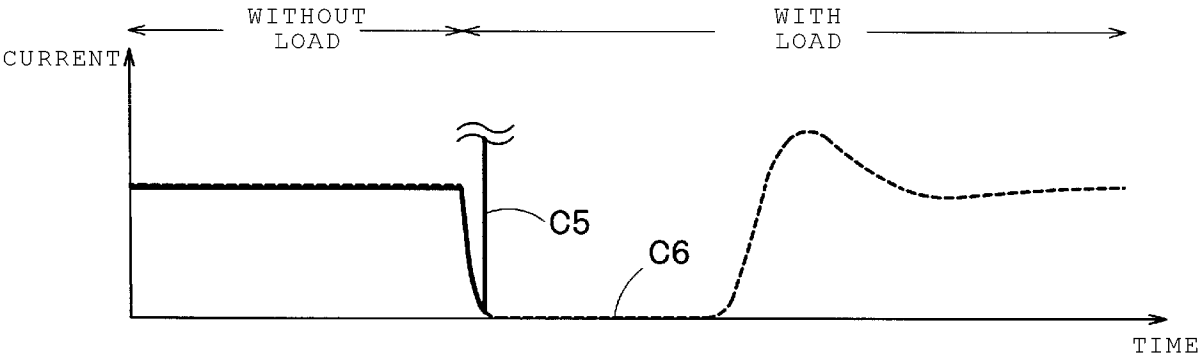
FIG. 4A, FIG. 4B and FIG. 4C are waveform diagrams for describing an operation of a power source device according to the first embodiment.
Figure 4B:
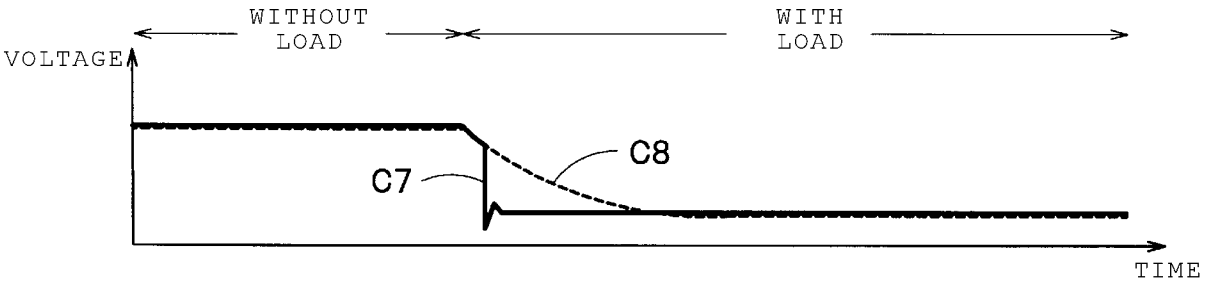
Figure 4C:
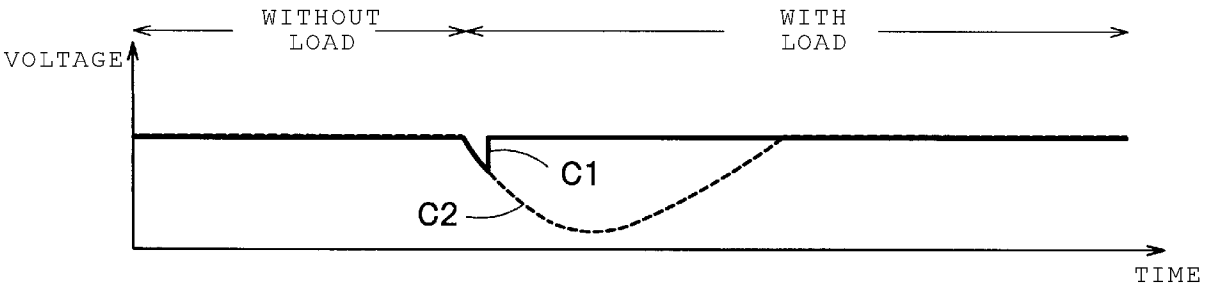

FIG. 4A, FIG. 4B and FIG. 4C are other waveform diagrams for describing the operation of the power source device 1 in the first embodiment.

In FIG. 4A and FIG. 4B, curves C5 and C7 respectively indicate a temporal change of the output current of the transistor P1 and a temporal change of the gate voltage of the first transistor Pp in the first embodiment, and curves C6 and C8 respectively indicate the a temporal change of the output current of the transistor P1 and a temporal change of the gate voltage of the first transistor Pp in the comparison example. The curves C5 to C8 indicate the changes of the output current and the gate voltage of the transistor P1 and the first transistor Pp in a case of change from the state in which the load 2 is not present to the state in which the load 2 is present. The curves C1 and C2 in FIG. 4C are substantially the same as the curves C1 and C2 in FIG. 3C.

When the load 2 is newly connected in the comparison example, the output voltage Vout starts to decrease (curve C2). In this case, the feedback circuit in the power source device 1 detects this decrease, and decreases the output current of the transistor P1 down to zero such that the gate voltage of the first transistor Pp is decreased (curves C6 and C8). As a result of the output current being zero, the gate voltage starts to decrease, but since the parasitic capacitance in the gate of the first transistor Pp continues to be discharged due to the fine current from the current source 20, it takes a long time for the output current and the gate voltage to be stabilized (curves C6 and C8).

Similarly, in the present embodiment, when the load 2 is newly connected, the output voltage Vout starts to decrease (curve C1). In this case, the feedback circuit of the power source device 1 detects the decrease and decreases the output current of the transistor P1 down to zero such that gate voltage of the first transistor Pp decreases (curves C5 and C7). In this case, the first switch SW1 is in an ON state and the parasitic capacitance in the gate of the first transistor Pp is quickly discharged due to the addition current from the second current source 14, and thus, the gate voltage is stabilized in a short time (curve C7).

Next, first and second modification examples of the first embodiment will be described.

Figure 5:
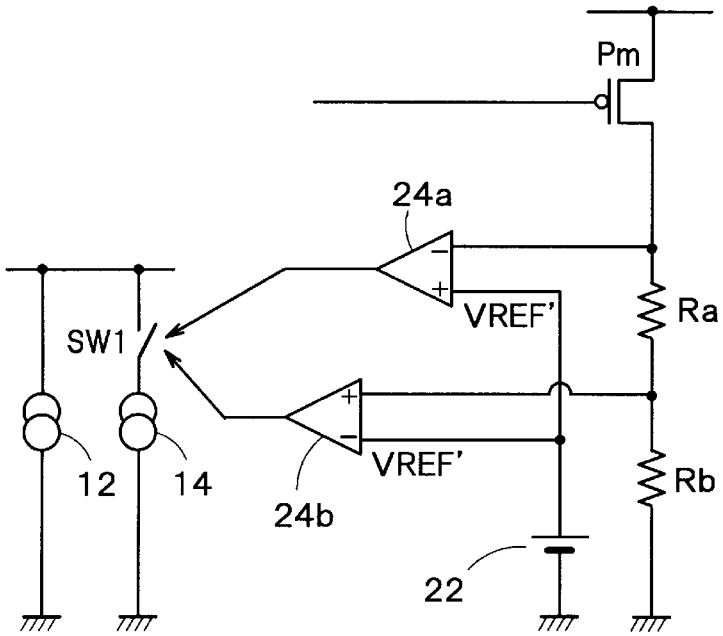
FIG. 5 is a circuit diagram illustrating a configuration of a power source device according to a first modification example of the first embodiment.

FIG. 5 is a circuit diagram illustrating a configuration of a power source device 1 in the first modification example of the first embodiment.

The power source device 1 in the first modification example includes a reference voltage source 22, a first voltage comparator 24*a*, a second voltage comparator 24*b*, and resistors Ra and Rb instead of the reference current source 16 and the current comparator 18. The other aspects of power source device 1 are as depicted in FIG. 1.

The resistors Ra and Rb are connected to each other in series between the drain of the second transistor Pm and the ground node. The reference voltage source 22 is a constant current source that supplies a reference voltage VREF' which is a constant voltage to be used as a threshold value to a non-inverting input terminal of the first voltage comparator 24*a* and a inverting input terminal of the second voltage comparator 24*b*.

A voltage is supplied to the inverting input terminal of the first voltage comparator 24*a* from a node between the drain of the second transistor Pm and the resistor Ra. The first voltage comparator 24*a* compares the supplied voltage and the reference voltage VREF' and outputs a first output signal indicating the result of comparison to the first switch SW1.

A voltage is supplied to the non-inverting input terminal of the second voltage comparator 24*b* from a node between the resistor Ra and the resistor Rb. The second voltage comparator 24*b* compares the supplied voltage and the reference current VREF' and outputs a second output signal indicating the result of comparison to the first switch SW1.

The first switch SW1 is operated based on the first and second output signals, and specifically, switches whether or not to supply a current to the first amplifier 10 from the second current source 14 based on the result of comparison by the first voltage comparator 24*a* and the result of comparison by the second voltage comparator 24*b*. For example, in a case where the voltage of the first voltage comparator 24*a* is higher than the reference voltage VREF' and the voltage of the second voltage comparator 24*b* is lower than the reference voltage VREF', the first switch SW1 is in an OFF state and the current is not supplied to the first amplifier 10 from the second current source 14. On the other hand, in a case where the voltage of the first voltage comparator 24*a* is lower than the reference voltage VREF' and the voltage of the second voltage comparator 24*b* is higher than the reference voltage VREF', the first switch SW1 is in an ON state and the current is supplied to the first amplifier 10 from the second current source 14.

According to the first modification example, the addition current can be supplied to the first amplifier 10 from the second current source 14 not only when the load 2 rapidly increases but also when the load 2 rapidly decreases, and thus, it is possible to more effectively suppress the fluctuations of the output voltage Vout. While the first switch SW1 is in an ON state based on the result of comparison by the first voltage comparator 24*a*, it is desirable to avoid an erroneous operation of the second voltage comparator 24*b* by simply stopping the comparison operation of the second voltage comparator 24*b*.

Figure 6A:
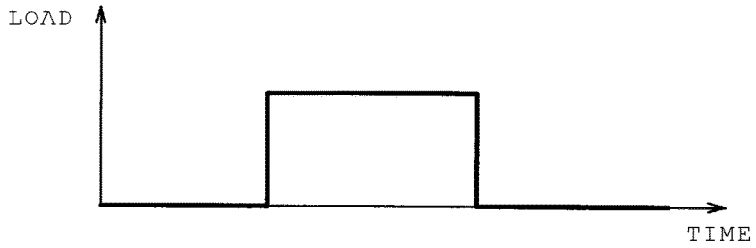
FIG. 6A, FIG. 6B and FIG. 6C are diagrams for describing an operation of a power source device according to the first modification example of the first embodiment.
Figure 6B:
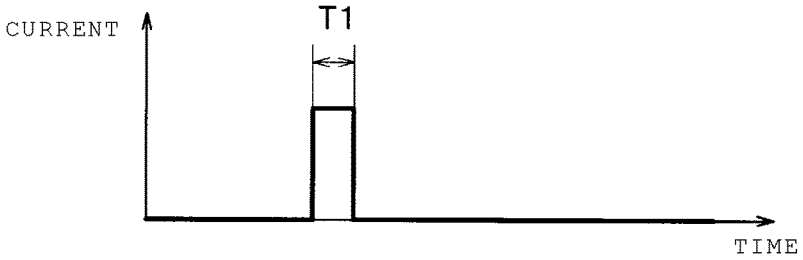
Figure 6C:
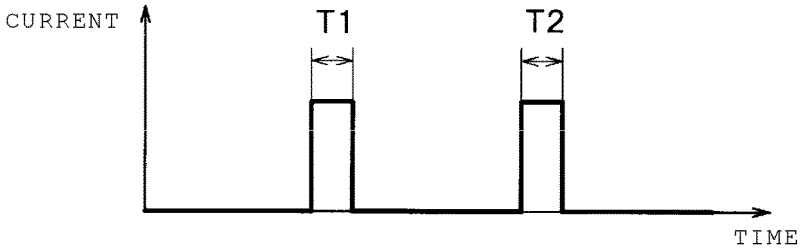

FIG. 6A, FIG. 6B and FIG. 6C are diagrams for describing the operation of the power source device 1 in the first modification example of the first embodiment.

FIG. 6A illustrates an example of the temporal change of the load 2 in the power source device 1 in FIG. 1 or FIG. 5. FIG. 6B and FIG. 6C illustrate the temporal changes of the addition current in a case of FIG. 6A.

In FIG. 6B, the addition current is supplied when the load 2 rapidly increases, which is realized by the power source device 1 in FIG. 1. The output voltage Vout at this time changes as illustrated by the curve C1 in FIG. 3A.

On the other hand, in FIG. 6C, the addition current is supplied when the load 2 rapidly increases or decreases, which is realized by the power source device 1 in FIG. 5. The output voltage Vout at this time changes as illustrated by the curve C1 in FIG. 3A and the curve C3 in FIG. 3B.

A symbol T1 indicates a duration of the addition current when the load 2 rapidly increases. A symbol T2 indicates a duration of the addition current when the load 2 rapidly decreases. In the first modification example, an extension circuit for extending the duration T1 and T2 could be provided in the power source device 1 in FIG. 1 or in FIG. 5. In this way, it is possible to avoid the complicated ON and OFF operation of the first switch SW1, and thus, it is possible to improve the stability of the feedback circuit.

Figure 7:
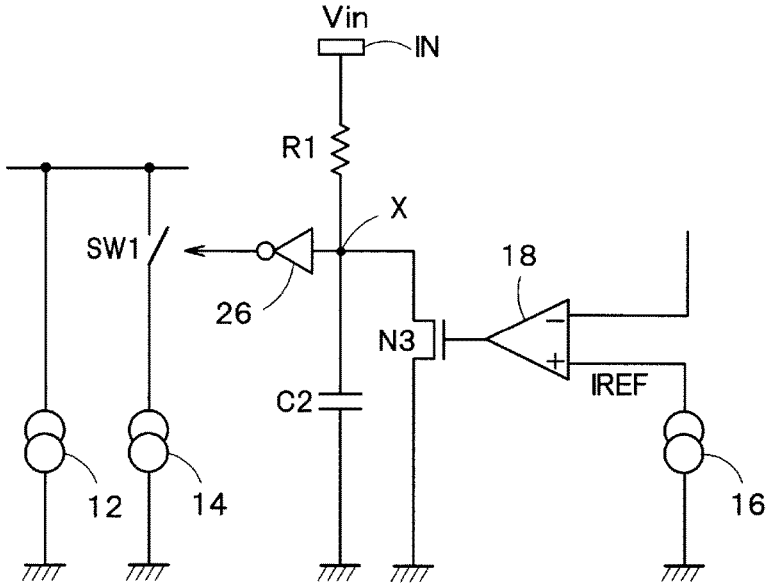
FIG. 7 is a circuit diagram illustrating a configuration of a power source device according to a second modification example of the first embodiment.

FIG. 7 is a circuit diagram illustrating a configuration of a power source device 1 in a second modification example of the first embodiment.

The power source device 1 in FIG. 7 is configured in such a manner that the power source device 1 in FIG. 1 is further provided with an extension circuit as described above. As elements of the extension circuit, the power source device 1 in FIG. 7 includes a transistor N3 and an inverter 26 provided in series between the current comparator 18 and the first switch SW1, a capacitor C2 provided between the ground node and a node X, and a pull-up resistor R1 provided between the input terminal IN and the node X. The node X is positioned between the transistor N3 and the inverter 26. Here, the transistor N3 is an nMOS transistor and includes a gate connected to the current comparator 18. A source and a drain of the transistor N3 are positioned between the inverter 26 and the ground node. The extension circuit can maintain the rising time of the addition current and can delay the falling time of the addition current, and accordingly, it is possible to extend the duration T1 of the addition current.

This extension circuit may also be provided in the power source device 1 in FIG. 5. In this case, it is possible to extend the durations T1 and T2 of the addition current.

As described above, the power source device 1 in the first embodiment compares the output current of the second transistor Pm and the reference current IREF and supplies the addition current to the first amplifier 10 from the second current source 14 based on the result of comparison. Therefore, according to the first embodiment, it is possible to achieve both low current consumption and high speed response from the power source device 1.

In addition, the power source device 1 in the first embodiment monitors the output current of the transistors P1 and P2 instead of the output current of the first transistor Pp, of which the sizes are smaller than that of the first transistor Pp, and then, controls the operation of the current comparator 18 and the first switch SW1. Therefore, according to the first embodiment, it is possible to realize the power source device 1 capable of quickly coping with the changes in the output voltage Vout.

Note also, in the first amplifier 10 in the first embodiment, the transistors N1 and N2 may be replaced with pMOS transistors and the transistors P1 and P2 may be replaced with nMOS transistors. In this case, the positional relationships between sources and drains of the transistors can be appropriately interchanged. The above-described reversing of conductivity type can also be applied to the second embodiment and the third embodiment described below. In addition, the first and second modification examples can also be applied to the second and the third embodiments described below.

Second Embodiment

Figure 8:
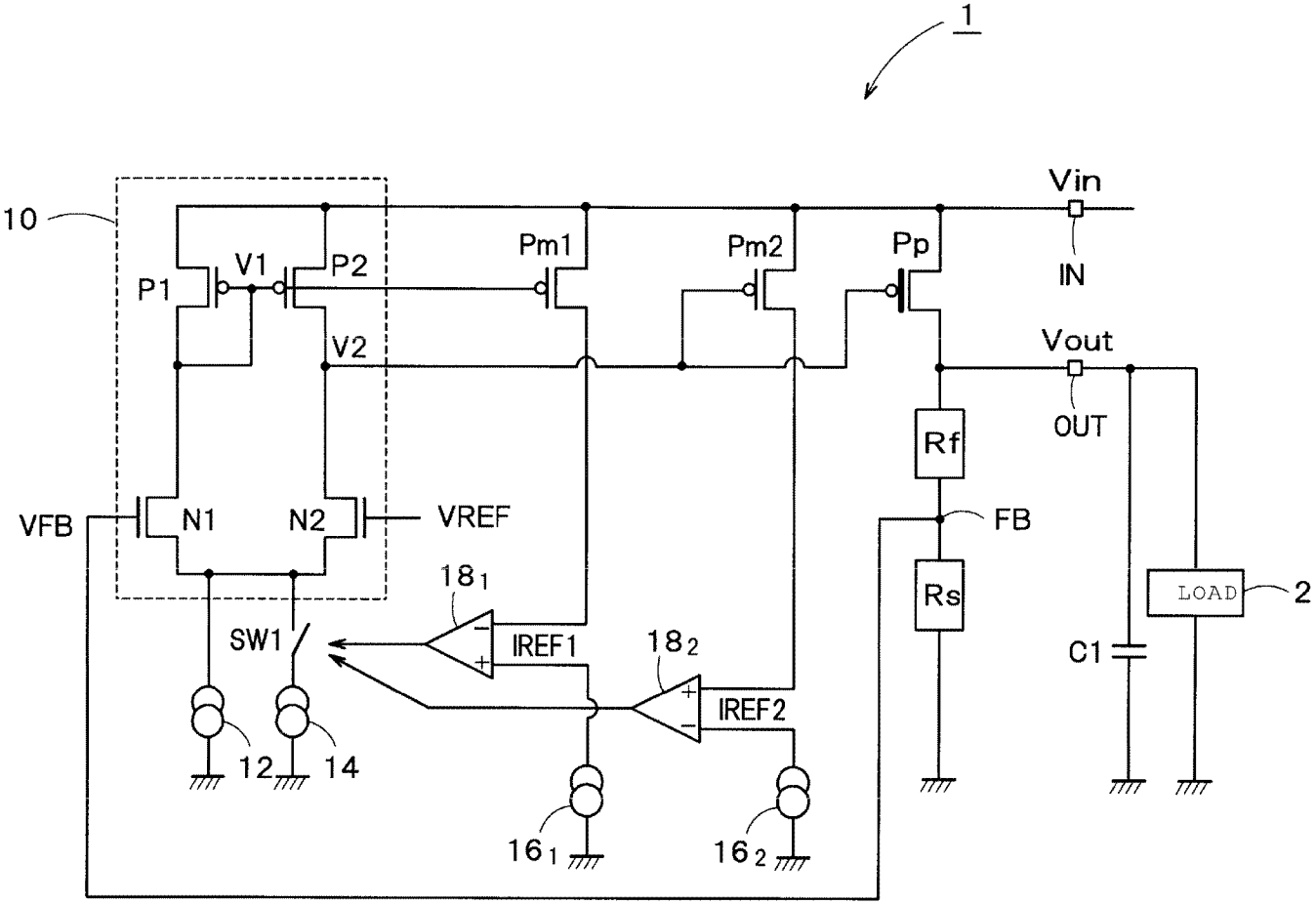
FIG. 8 is a circuit diagram illustrating a configuration of a power source device according to a second embodiment.

FIG. 8 is a circuit diagram illustrating a configuration of a power source device 1 in the second embodiment.

The power source device 1 in FIG. 8 includes a first reference current source $\mathbf{16}_1$, a second reference current source $\mathbf{16}_2$, a first current comparator $\mathbf{18}_1$, a second current comparator $\mathbf{18}_2$, a second transistor Pm1, and a third transistor Pm2 instead of the reference current source 16, current comparator 18 and the second transistor Pm as depicted in FIG. 1. Here, the second transistor Pm1 and the third transistor Pm2 are pMOS transistors.

Similarly to the second transistor Pm in the first embodiment, the second transistor Pm1 is a monitor transistor that monitors the output current of the transistors P1 and P2, and outputs a current corresponding to the output current of the transistors P1 and P2. A source of the second transistor Pm1 is connected to the input terminal IN. A drain of the second transistor Pm1 is connected to an inverting input terminal of the first current comparator $\mathbf{18}_1$. A gate of the second transistor Pm1 is connected to the gates of the transistors P1 and P2 and the first voltage V1 is applied thereto. The second transistor Pm1 forms a current mirror circuit with the transistors P1 and P2, and outputs a current proportional to the output current of the transistor P1 or the output current of the transistor P2.

The first reference current source $\mathbf{16}_1$ is a constant current source that supplies a reference current IREF1 which is a constant current to be used as a first threshold value to a non-inverting input terminal of the first current comparator $\mathbf{18}_1$. The first current comparator $\mathbf{18}_1$ compares the output current of the second transistor Pm1 and the reference current IREF1, and outputs a first output signal indicating the result of comparison to the first switch SW1.

The third transistor Pm2 is a monitor transistor that monitors the output current of the first transistor Pp and outputs the current corresponding to the output current of the first transistor Pp. A source of the third transistor Pm2 is connected to the input terminal IN. A drain of the third transistor Pm2 is connected to an inverting input terminal of the second current comparator $\mathbf{18}_2$. A gate of the third transistor Pm2 is connected to the drain of the transistor P2 and the second voltage V2 is applied thereto. The third transistor Pm2 forms a current mirror circuit with the first transistor Pp and outputs a current proportional to the output current of the first transistor Pp.

The second reference current source $\mathbf{16}_2$ is a constant current source that supplies a reference current IREF2 which is a constant current to be used as a second threshold value to a inverting input terminal of the second current comparator $\mathbf{18}_2$. The second current comparator $\mathbf{18}_2$ compares the output current of the third transistor Pm2 and the reference current IREF2, and outputs a second output signal indicating the result of comparison to the first switch SW1.

The first switch SW1 is operated based on the first and second output signals, and specifically, switches whether or not to supply current to the first amplifier 10 from the second current source 14 based on the result of comparison by the first current comparator $\mathbf{18}_1$ and the result of comparison by the second current comparator $\mathbf{18}_2$. For example, in a case where the current in the first current comparator $\mathbf{18}_1$ is larger than the reference current IREF1 and the current in the second current comparator $\mathbf{18}_2$ is smaller than the reference current IREF2, the first switch SW1 is in an OFF state (switch SW1 is open), and the current is not supplied to the first amplifier 10 from the second current source 14. On the other hand, in a case where the current in the first current comparator $18_1$ is smaller than the reference current IREF1 and the current in the second current comparator $18_2$ is larger than the reference current IREF2, the first switch SW1 is in an ON state, and the current is supplied to the first amplifier 10 from the second current source 14.

Next, an operation of the power source device 1 in the second embodiment will be described in detail.

In the first embodiment, the mode is returned to the low current consumption mode regardless of an amount of the load current when the fluctuation of the output voltage Vout is received while in the high speed response mode. On the other hand, since the power source device 1 in the second embodiment includes the third transistor Pm2, the high speed response mode is maintained regardless of the size of the fluctuation of the output voltage Vout when the load current is large.

Specifically, the first switch SW1 in the second embodiment is operated based on an OR operation result between the first output signal from the first current comparator $18_1$ and the second output signal from the second current comparator $18_2$. Accordingly, if it is determined that any of the second and third transistors Pm1 and Pm2 needs the addition current, the low current consumption mode is shifted to the high speed response mode or the high speed response mode can be maintained as it is.

In the second embodiment, it can be determined that both the second and third transistors Pm1 and Pm2 do not need the addition current, and the first amplifier 10 can be operated only with the small current from the first current source 12. Since current value of the small current is low, the low current consumption can be realized by operating the first amplifier 10 only with the small current.

On the other hand, if it is determined that any of the second and third transistor Pm1 and Pm2 needs the addition current, the first amplifier 10 can be operated with the fine current from the first and the second current sources 12 and 14 and the addition current. That is, in any case where the fluctuations of the output voltage Vout is large or the load current is large, the high speed response can be realized by the first amplifier 10 being operated with the small current and the addition current.

Therefore, according to the second embodiment, it is possible to promote the high speed response more effectively using the addition current than in the first embodiment. On the other hand, it is possible to promote reduction of current consumption in the first embodiment.

In the high speed response mode of the first and second embodiments, the delay time in the feedback operation in the power source device 1 is relatively short. The reason is because the addition current is large and therefore even when the gate parasitic capacitance of the first transistor Pp is large, the time required for charging and discharging the gate parasitic capacitance can still be short.

In addition, the size of the second transistor Pm1 can be designed to be similar to the size of the second transistor Pm in the first embodiment. Therefore, the size of the second transistor Pm1 may be larger than the sizes of the transistors P1 and P2 or may be smaller than the sizes of the transistors P1 and P2. The second transistor Pm1 in the second embodiment is designed to have a size of ½ to ⅕ of the sizes of the transistors P1 and P2. Since the second transistor Pm1 in the second embodiment does not monitor the output current of the first transistor Pp but rather monitors the output current of the transistors P1 and P2, the size of the second transistor Pm1 can be reduced as described above.

Third Embodiment

Figure 9:
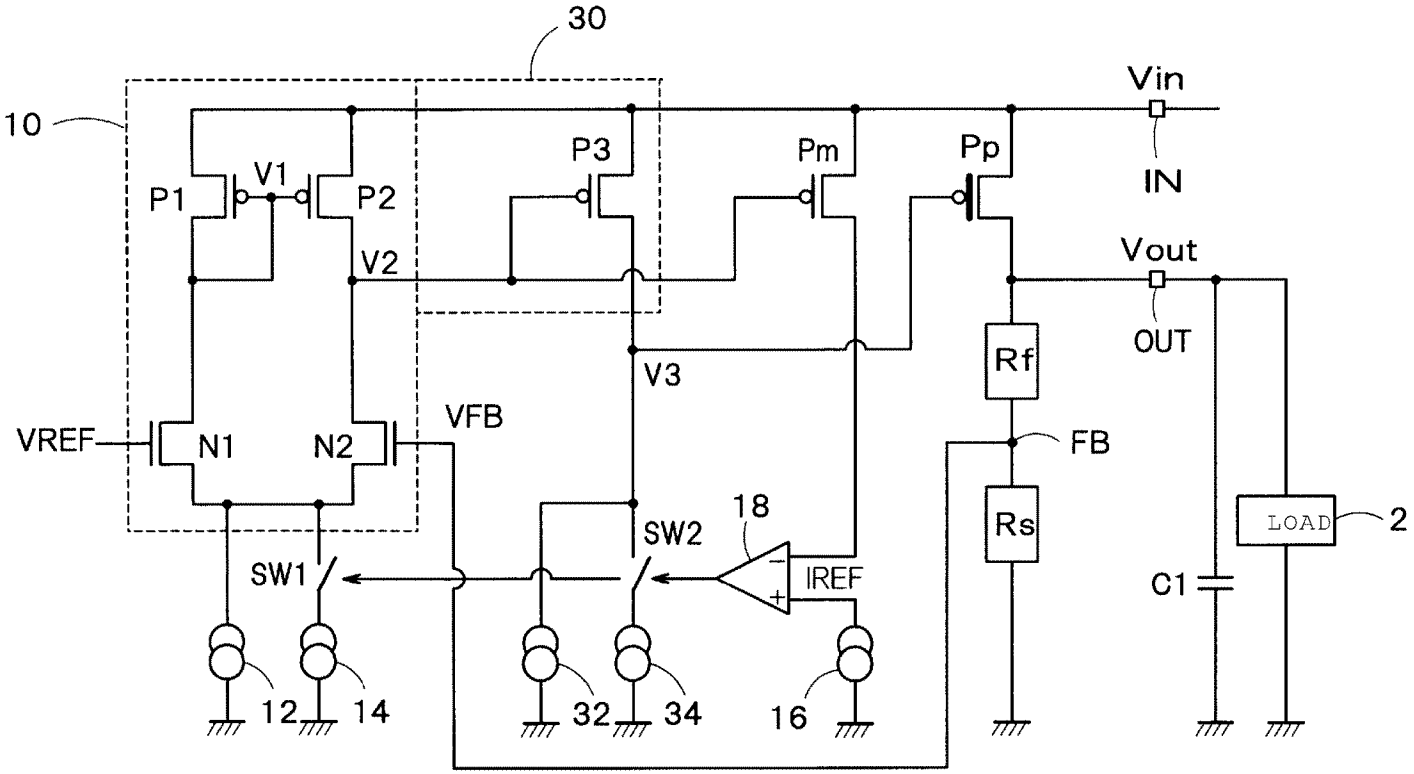
FIG. 9 is a circuit diagram illustrating a configuration of a power source device according to a third embodiment.

FIG. 9 is a circuit diagram illustrating a configuration of a power source device 1 in a third embodiment.

The power source device 1 in FIG. 9 includes a second amplifier 30, a third current source 32, a fourth current source 34, and a second switch SW2 in addition to the configuration elements in FIG. 1. The second amplifier 30 includes a transistor P3, which is an example of a third element. The transistor P3 here is a pMOS transistor, but can be replaced by an nMOS transistor.

The second amplifier 30 is a circuit that amplifies the second voltage V2 output from the first amplifier 10 and outputs a third voltage V3. The third voltage V3 is applied to the gate of the first transistor Pp, and operation of the first transistor Pp is controlled by the third voltage V3. As described above, the operation of the first transistor Pp in the third embodiment is controlled not by the second voltage V2 itself but by the third voltage V3 dependent on the second voltage V2.

A source of the transistor P3 is connected to the input terminal IN. A drain of the transistor P3 is connected to the third current source 32 and can be connected to the fourth current source 34 via the second switch SW2. A gate of the transistor P3 is connected to the drain of the transistor P2 and the second voltage V2 is applied thereto.

The third current source 32 is a constant current source that supplies a current flowing into the second amplifier 30. The fourth current source 34 is a constant current source that supplies a current flowing into second amplifier 30 when the second switch SW2 is in an ON state.

The second transistor Pm in the third embodiment is a monitor transistor that monitors the output current of the transistor P3, and outputs a current corresponding to the output current of the transistor P3. The gate of the second transistor Pm is connected to the drain of the transistor P2 and the gate of the transistor P3, and the second voltage V2 is applied thereto. The second transistor Pm configures a current mirror circuit with the transistor P3, and outputs a current proportional to the output current of the transistor P3.

The reference current source 16 is a constant current source that supplies a reference current IREF which is a constant current to be used as the threshold value to a non-inverting input terminal of the current comparator 18. The current comparator 18 compares the output current of the second transistor Pm and the reference current IREF, and outputs an output signal indicating the result of comparison to the first and second switches SW1 and SW2.

The second switch SW2 is operated based on the output signal, and specifically, switches whether or not to supply the current to the second amplifier 30 from the fourth current source 34 based on the result of comparison of the output current of the second transistor Pm and the reference current IREF. For example, in a case where the above-described output current is larger than the reference current IREF, the second switch SW2 is in an OFF state, and the current is not supplied to the second amplifier 30 from the fourth current source 34. On the other hand, in a case where the above-described output current is smaller than the reference current IREF, the second switch SW2 is in an ON state, and the current is supplied to the second amplifier 30 from the fourth current source 34. The operation of the first switch SW1 is similar to that in the first embodiment.

Next, an operation of the power source device 1 in the third embodiment will be described in detail.

The second amplifier 30 is provided at the stage subsequent to the first amplifier 10 and the first and second amplifiers 10 and 30 function as first and second gain stages respectively. The second amplifier 30 receives the output voltage (the second voltage V2) of the first amplifier 10 through the gate of the transistor P3 and outputs the output voltage (the third voltage V3) of the second amplifier 30 from the drain of the transistor P3. The gate of the first transistor Pp is charged by the third voltage V3, and as a result thereof, the voltage of this gate increases.

A current from the third current source 32 and an addition current from the fourth current source 34 have a role in discharging the gate of the first transistor Pp, that is, decreasing the voltage of the gate. The second amplifier 30 is positioned in the feedback path of the power source device 1 and has a function of increasing the open gain of the feedback circuit. According to the third embodiment, by increasing the open gain of the feedback circuit using the second amplifier 30, a noise in the output voltage Vout can be reduced or an influence from the noise in the input signal Vin on the output signal Vout can be decreased.

The transistor P3 can be designed to have a size similar to the sizes of the transistors P1 and P2 in the first embodiment. Accordingly, the transistor P3 in the third embodiment is designed to have a size smaller than the size of the first transistor Pp, and can operate at a higher speed than the first transistor Pp. Therefore, the second transistor Pm in the third embodiment can quickly cope with the change of the output voltage Vout by monitoring the output current of the transistor P3.

Figure 10:
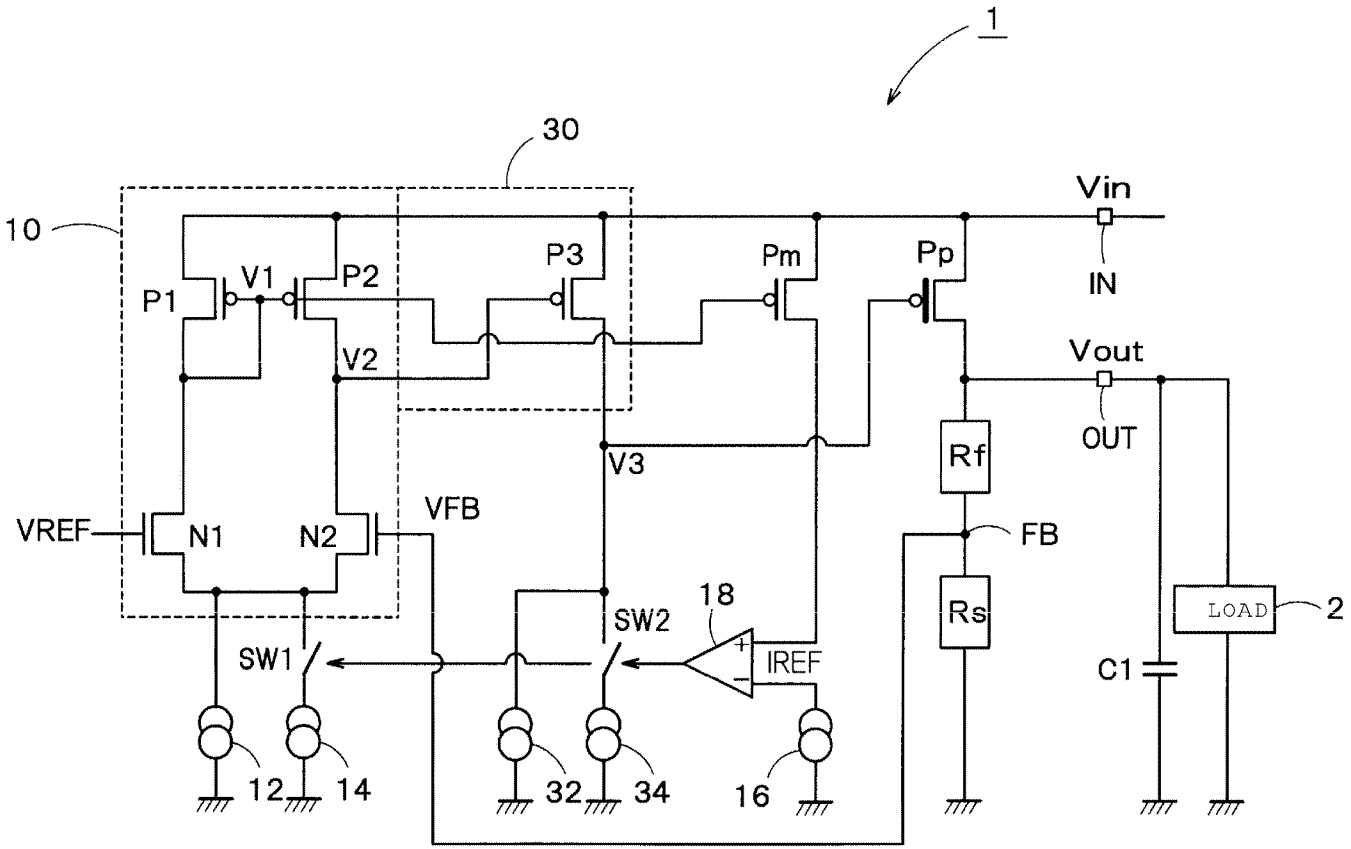
FIG. 10 is a circuit diagram illustrating a configuration of a power source device according to a modification example of the third embodiment.

FIG. 10 is a circuit diagram illustrating a configuration of a power source device 1 in a modification example of the third embodiment.

The power source device 1 in FIG. 10 includes the same elements as the power source device 1 in FIG. 9. However, the gate of the second transistor Pm is connected to the gates of the transistors P1 and P2, not to the gate of the transistor P3. Accordingly, similarly to that in the first embodiment, the second transistor Pm in this modification example is a monitor transistor that monitors the output current of the transistors P1 and P2 and outputs a current corresponding to the output current of the transistors P1 and P2. The first voltage V1 is applied to the gate of the second transistor Pm in this present modification example. In addition, in the current comparator 18 in this present modification example, a non-inverting input terminal is connected to the reference current source 16 and an inverting input terminal is connected to the second transistor Pm.

As described above, the power source device 1 in the third embodiment includes the second amplifier 30 at the stage subsequent to the first amplifier 10. Therefore, it is possible to suppress the problem of offset or noise related to the input signal Vin and the output signal Vout.

The configuration in FIG. 9 and the configuration in FIG. 10 can be applied to the first embodiment and the second embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power source device, comprising:

an output transistor connected between an input node at which an input voltage can be received and an output node at which an output voltage corresponding to the input voltage can be output according to a control voltage applied to a gate of the output transistor;

a first amplifier that includes a first transistor element and a second transistor element having gates to which a first voltage is applied, receives a feedback voltage corresponding to the output voltage, and outputs a second voltage corresponding to a voltage difference between the feedback voltage and a reference voltage;

a monitor transistor having a gate to which the first voltage is applied;

a first current source that supplies a first current to the first amplifier; and a second current source that supplies a second current to the first amplifier according to a current flowing in the monitor transistor.

2. The power source device according to claim 1, wherein the monitor transistor monitors a current flowing in the first transistor element and a current flowing in the second transistor element.

3. The power source device according to claim 1, further comprising:

a first switch between the second current source and the first amplifier that switches whether or not the second current is supplied to the first amplifier according to a comparison of a reference value to the current flowing in the monitor transistor.

4. The power source device according to claim 3, further comprising:

a comparator that compares the current flowing in the monitor transistor to the reference value, wherein the first switch switches based on an output signal from the comparator.

5. The power source device according to claim 1, further comprising:

a first switch between the second current source and the first amplifier that switches whether or not the second current is supplied to the first amplifier according to a comparison of a reference value to a voltage that is output from the monitor transistor.

6. The power source device according to claim 5, further comprising:

a comparator that compares the reference value to the voltage output from the monitor transistor, wherein the first switch switches based on an output signal from the comparator.

7. The power source device according to claim 1, further comprising:

a third transistor element having a gate to which the second voltage is applied, wherein the second current source supplies the second current to the first amplifier based on the current flowing in the monitor transistor and a current flowing in the third transistor element.

8. The power source device according to claim 1, wherein a control voltage applied to the gate of the output transistor is the second voltage.

9. The power source device according to claim 1, further comprising:

a comparator circuit configured to compare the current flowing in the monitor transistor to a reference current and to output a switching signal to the first switch according the comparison; and an extension circuit between the comparator circuit and the first switch and configured to delay the switching signal for a predetermined time period.

10. The power source device according to claim 1, wherein the output transistor, the monitor transistor, the first transistor element, the second transistor element are each p-channel metal-oxide-semiconductor field effect transistors.

11. The power source device according to claim 1, wherein the monitor transistor is connected between the input node and a control terminal of a first switch connected between the first amplifier and the second current source.

12. A power source device, comprising:

an output transistor connected between an input node at which an input voltage can be received and an output node at which an output voltage corresponding to the input voltage can be output according to a control voltage applied to a gate of the output transistor;

a first amplifier that includes a first transistor element and a second transistor element each having gates to which a first voltage is applied, receives a feedback voltage corresponding to the output voltage, and outputs a second voltage corresponding to a voltage difference between the feedback voltage and a reference voltage;

a second amplifier that includes a third transistor element having a gate to which the second voltage is applied, and accordingly outputs a third voltage as the control voltage applied to the gate of the output transistor;

a monitor transistor having a gate to which the second voltage is applied;

a first current source that supplies a first current to the first amplifier; and a second current source that supplies a second current to the first amplifier according to a current flowing in the monitor transistor.

13. The power source device according to claim 12, further comprising:

a third current source that supplies a third current to the second amplifier; and a fourth current source that supplies a fourth current to the second amplifier according to the current flowing in the monitor transistor.

14. The power source according to claim 12, further comprising:

a first switch between the second current source and the first amplifier;

a third current source that supplies a third current to the second amplifier;

a fourth current source that supplies a fourth current to the second amplifier;

a second switch between the second current source and the second amplifier; and a comparator configured to compare the current flowing in the monitor transistor to a reference value and output an output signal according to the comparison to a control terminal of the first switch and a control terminal of the second switch.

15. A power source device comprising:

an output transistor connected between an input node at which an input voltage can be received and an output node at which an output voltage corresponding to the input voltage can be output according to a control voltage applied to a gate of the output transistor;

a first amplifier that includes a first transistor element and a second transistor element having gates to which a first voltage is applied, receiving a feedback voltage corresponding to the output voltage, and outputting a second voltage corresponding to a difference between the feedback voltage and a reference voltage;

a second amplifier that includes a third transistor element having a gate to which the second voltage is applied and outputting the control voltage to the gate of the output transistor according to second voltage;

a monitor transistor having a gate to which the first voltage is applied;

a first current source that supplies a first current to the first amplifier; and a second current source that supplies a second current to the first amplifier based on a current flowing in the monitor transistor.

16. The power source device according to claim 15, further comprising:

a first switch that switches whether or not the second current is supplied to the first amplifier from the second current source according to a comparison of the current flowing in the monitor transistor to a reference value.

17. The power source device according to claim 15, further comprising:

a third current source that supplies a third current to the second amplifier; and a fourth current source that supplies a fourth current to the second amplifier according to the current flowing in the monitor transistor.

18. The power source device according to claim 17, further comprising:

a second switch that switches whether or not the fourth current is supplied to the second amplifier from the fourth current source based on a comparison of the current flowing in the monitor transistor to a reference value.

19. The power source device according to claim 15, the output transistor, the first transistor element, the second transistor element, the third transistor element, and the monitor transistor are each p-channel metal-oxide-semiconductor field effect transistors.

20. The power source device according to claim 15, wherein the monitor transistor has a size that at least one-half of a size of the first transistor element.

* * * * *